United States Patent [19]

Matsuzaki

[11] Patent Number: 4,490,175

[45] Date of Patent: Dec. 25, 1984

[54] VANE FOR ROTARY FLUID COMPRESSORS

[75] Inventor: Michiyoshi Matsuzaki, Saitama, Japan

[73] Assignee: Nippon Piston Ring Co., Ltd., Tokyo, Japan

[21] Appl. No.: 547,616

[22] Filed: Nov. 1, 1983

[30] Foreign Application Priority Data

Nov. 2, 1982 [JP] Japan ..... 57-191797

[51] Int. Cl.[3] ..... C22C 38/22

[52] U.S. Cl. ..... 75/126 C; 75/126 E; 148/37; 415/148

[58] Field of Search ..... 75/126 C, 126 E; 148/37, 12 R, 14, 35; 415/148, 208, 191

[56] References Cited

U.S. PATENT DOCUMENTS 4,141,760 2/1979 Baldi ..... 148/31.5

4,302,256 3/1981 Kenton ..... 148/131

*Primary Examiner*—L. Dewayne Rutledge

*Assistant Examiner*—Debbie Yee

*Attorney, Agent, or Firm*—Sughrue, Mion, Zinn, Macpeak and Seas

[57] ABSTRACT

An improved vane for a rotary fluid compressor for which the rate of abrasive wear is matched to that of the mating rotor. The vane is made from a steel material consisting of 0.7–1.3 wt % of C, 13–20 wt % of Cr, and at least one of 0.3–1.5 wt % of Mo and 0.07–0.15 wt % of V, the balance being iron. Alternatively, the material may further contain not more than 1.0 wt % of Si and not more than 1.0 wt % of Mn. A vane so formed is ideal, in abrasion characteristics, for use with a Mo-Ni-Cr cast iron rotor.

2 Claims, 3 Drawing Figures

VANE FOR ROTARY FLUID COMPRESSORS

BACKGROUND OF THE INVENTION

A rotary fluid compressor provided with a vane, more particularly, a rocking rotor type, is constructed as shown in FIG. 1 where a vane 4 is inserted into a vane groove 3 formed in a rotor housing 2 within a case 1. Vane 4 is freely movable into and removable from vane groove 3. A rotor 5 is mounted rotatably on a crankshaft 6, the latter being concentric with the rotor housing 2. Vane 4 is urged inwardly by a spring, and thus moves back and forth in rotor housing 2 in response to rotation of eccentric rotor 5. In operation, as shown in FIG. 2, vane 4 moves slidably within vane groove 3 with an inclination in the rotation direction of rotor 5 due to frictional pulling by rotor 5. With this construction there arises a problem of abrasion at a vane nose 10, between an inlet portion 9 of vane groove 3 and a side 11 of vane 4, and between a back end portion 12 of vane 4 and a side surface 7 of vane groove 3. Particularly, between vane side 11 and vane groove inlet portion 9 a biting abrasion takes place due to accumulation of abrasive particles in vane groove 3, in addition to sliding abrasion. Therefore, it is necessary to fabricate the vane of the rotary fluid compressor from materials having a superior wear resistance.

The leading materials known to date for compressor. vanes are SUJ2 (a high carbon chrome bearing steel) and SKH9 (a high speed tool steel) specified in the JIS (Japan Industrial Standards). These materials, however, have some drawbacks with respect to their wear resistance. In the case that SUJ2 material is used to form the vane, the amount of precipitation of Cr carbide, which has a high hardness, is so little that its wear resistance is inferior, and thus abrasive wear of the vane itself is high in comparison to the rotor and the vane groove portion which is touches. On the other hand, in the case of SKH9, the precipitation of high hardness carbides including Cr, Mo, W and V is so high that the rotor and the vane groove tend to suffer higher wear than the vane.

SUMMARY OF THE INVENTION

It is thus an object of the invention to provide a vane for a rotary fluid compressor ideally compatible with the rotor and the vane groove in the point of view of wear resistance.

This object is achieved by increasing the amount of Cr in comparison to that present in the previously known vane materials described above. The net effect is to moderate the amount of precipitation of chromium carbide.

DESCRIPTION OF THE PREFERRED EMBODIMENTS

The vane material according to the invention is a steel material which contains 0.7–1.3 wt % of C, 13–20 wt % of Cr, and either or both of 0.3–1.5 wt % of Mo and 0.07–0.15 wt % of V, together with the remaining Fe and unavoidable impurity compositions. (The term "wt %" stands for percentage by weight.) Alternatively, the steel material may contain, in addition to the foregoing, not more than 1.0 wt % of Si and not more than 1.0 wt % of Mn.

The reasons for the specified limits will now be described. While C is preferably present in an amount of 0.7–1.3 wt %, C of more than 1.3 wt % forms an excessive amount of chromium carbide, thereby excessively increasing the abrasion resistance. On the other hand, C in an amount of less than 0.7 wt % forms very little chromium carbide, thus excessively lowering the abrasion resistance. While Cr is preferably present in an amount of 13–20 wt %, more than 20 wt % of Cr causes excessive formation of chromium carbide, resulting in excessive wear of the mating material. On the other hand, Cr of less than 13 wt % results in formation of little chromium carbide, and hence a lowered abrasion resistance. While Mo is preferably present in an amount of 0.3–1.5 wt %, Mo of more than 1.5 wt % does not contribute to the strength of the matrix and to promote the formation of chromium carbide. Also, Mo of less than 0.3 wt % is not effective to strengthen the matrix. While V is preferably present in an amount of 0.07–0.15 wt %, if the amount of V is not within the given limits, formation of the carbide is inhibited. If Si is added in an amount of more than 1.0 wt %, the low-temperature toughness is lowered. Similarly, Mn in an amount of more than 1.0 wt % lowers the oxidation resistance.

Figure 1:
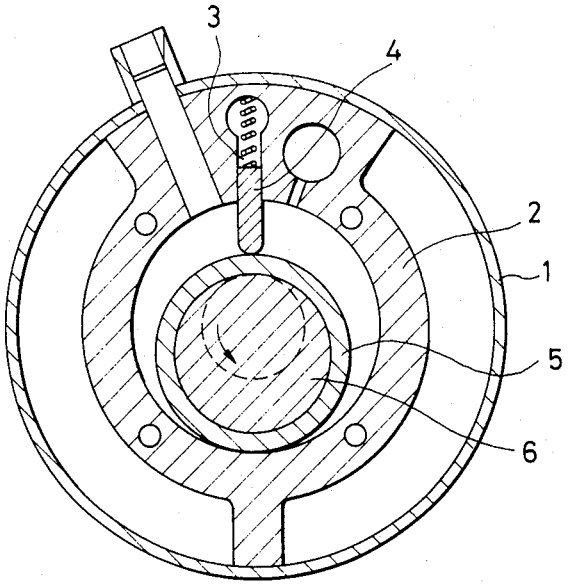
FIG. 1 is a sectional view of essential portions of a rocking rotor type rotary fluid compressor.
Figure 2:
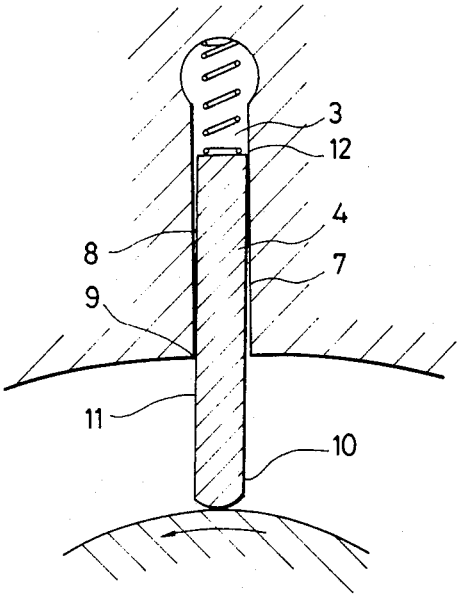
FIG. 2 is an enlarged sectional view of a portion around the vane in FIG. 1.
Figure 3:
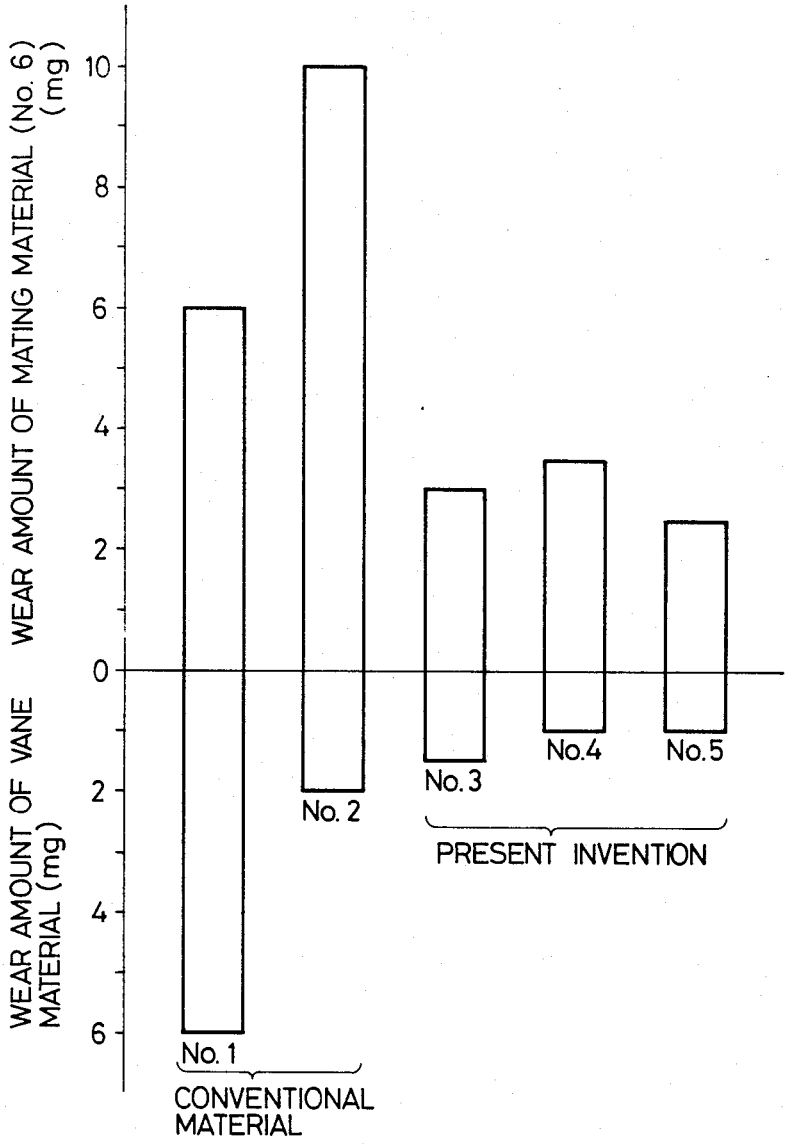
FIG. 3 is a graph showing results of an abrasion test.

FIG. 3 is the graph showing the results of a wear test in which vanes fabricated according to the invention were compared with vanes made from conventional materials. In both cases, the mating member was a rotor made of Mo-Ni-Cr cast iron. Table 1 below shows the components and hardnesses of the conventional vane materials, the vane materials of the invention, and the mating rotor material, where No. 1 . . . conventional vane material (JIS–SUJ2)

No. 2 . . . another conventional vane material (JIS–SKH9)

No. 3 to No. 5 . . . inventive vane materials

No. 6 . . . mating rotor material (Mo-Ni-Cr cast iron).

TABLE 1

| Specimens | Chemical Composition (wt %) | | | | | | | | | | | Hardness (HRC) |
|---|---|---|---|---|---|---|---|---|---|---|---|---|
| | C | Si | Mn | P | S | Cr | Mo | V | W | Ni | Fe | |
| Conventional material No. 1 | 1.0 | 0.2 | 0.3 | 0.01 | 0.01 | 1.45 | — | — | — | — | remainder | 58 |
| Conventional material No. 2 | 0.85 | 0.2 | 0.25 | 0.01 | 0.01 | 4.0 | 5.05 | 1.78 | 6.13 | — | " | 62 |
| Invention material No. 3 | 0.7 | 0.7 | 0.6 | 0.02 | 0.01 | 13.0 | — | — | — | — | " | 48 |
| Invention | 1.3 | 0.7 | 0.6 | 0.02 | 0.01 | 20.0 | — | — | — | — | " | 50 |

TABLE 1-continued

| Specimens | Chemical Composition (wt %) C | Si | Mn | P | S | Cr | Mo | V | W | Ni | Fe | Hardness (HRC) |
|---|---|---|---|---|---|---|---|---|---|---|---|---|
| material No. 4 Invention material No. 5 | 1.1 | 0.7 | 0.6 | 0.02 | 0.01 | 16.0 | 1.1 | 0.1 | — | — | " | 56 |
| Mating material No. 6 | 3.3 | 2.0 | 0.88 | 0.18 | 0.08 | 0.92 | 0.18 | — | — | 0.19 | " | 48 |

The test was performed according to the Amsler Wear Test, and the conditions of the test were as follows:

| | |
|---|---|
| lubricating oil | SUNISO 4GD1D (product by Japan Sun Oil Co.) |
| oil temperature | 80° C. |
| load | 200 kg |
| sliding speed | 0.5 m/sec |
| oil pan system content | 200 cc |

As seen from the results presented in FIG. 3, the vane material according to the invention, as well as the mating rotor material, is remarkably reduced in the amount of wear compared with the prior art materials.

I claim:

1. A vane for a rotary fluid compressor, said vane being insertable slidingly in a vane groove of said compressor, characterized in that said vane is made from a steel material consisting essentially of 0.7–1.3 wt % of C, 13–20 wt % of Cr, and at least one of 0.3–1.5 wt % of Mo and 0.07–0.15 wt % of V, the balance being Fe and unavoidable impurity compositions.

2. The vane for a rotary fluid compressor as claimed in claim 1, characterized in that said steel material further consists of not more than 1.0 wt % of Si and not more than 1.0 wt % of Mn.

* * * * *